United States Patent [19]

Sakai et al.

[11] 4,217,806

[45] Aug. 19, 1980

[54] AUTOMATIC RHYTHM GENERATING METHOD AND APPARATUS IN ELECTRONIC MUSICAL INSTRUMENT

[75] Inventors: Tadao Sakai, Hamamatsu; Yukio Tamada, Amagasaki, both of Japan

[73] Assignee: Roland Corporation, Osaka, Japan

[21] Appl. No.: 973,605

[22] Filed: Dec. 27, 1978

[30] Foreign Application Priority Data

Sep. 28, 1978 [JP] Japan ..... 53/120102

[51] Int. Cl.[3] ..... G10H 1/40

[52] U.S. Cl. ..... 84/1.03; 84/DIG. 12

[58] Field of Search ..... 84/1.01, 1.03, DIG. 12

[56] References Cited

U.S. PATENT DOCUMENTS

| | | | |
|---|---|---|---|
| 3,840,691 | 10/1974 | Okamoto | 84/1.03 |
| 3,958,483 | 5/1976 | Borrevik et al. | 84/1.03 |
| 4,058,043 | 11/1977 | Shibahara | 84/1.03 |
| 4,135,423 | 1/1979 | Gross | 84/1.03 |
| 4,163,407 | 8/1979 | Solender | 84/1.03 |

*Primary Examiner*—S. J. Witkowski

*Attorney, Agent, or Firm*—W. G. Fasse; D. F. Gould

[57] ABSTRACT

A read only memory is provided, which has a plurality of storing regions allotted for a plurality of kinds of rhythm patterns, each region having a plurality of addresses for storing, in an address sequence, a rhythm pattern of a shortest rhythm pattern unit represented by a combination of information units in the form of logic "ones" and logic "zeros", the logic "one"; representing a note being generated and the logic zero representing a note being not generated, whereby the notes are represented in binary form, whereby the required number of information units is reduced compared to the prior art. Each address in the memory has a plurality of bit positions allotted to a plurality of kinds of musical instruments, whereby a plurality of kinds of rhythm patterns are stored for a plurality of kinds of musical instruments. A matrix is provided for presetting the number of steps in terms of clock signals for each kind of rhythm pattern required for reading the stored rhythm pattern in a repetitive manner for generating a desired rhythm as a repetition of the shortest rhythm pattern unit. An address counter is coupled to the read only memory and responsive to the clock signals for addressing the same. An address control is responsive to the number of clock signals preset by the matrix for controlling the address counter for skipping the addresses each time the preset number of clock signals are provided. As a result, the number of addresses used in the read only memory is reduced. The outputs of the read only memory read in a bit parallel fashion from each of the addresses as addressed are applied to tone generators for generation of a mixed rhythm signal.

14 Claims, 8 Drawing Figures

AUTOMATIC RHYTHM GENERATING METHOD AND APPARATUS IN ELECTRONIC MUSICAL INSTRUMENT

BACKGROUND OF THE INVENTION

1. Field of the Invention

The present invention relates to an automatic rhythm generation in an electronic musical instrument. More specifically, the present invention relates to an automatic rhythm generating method and apparatus in an electronic musical instrument for automatically generating a rhythm signal responsive to rhythm information stored in a storage of a relatively decreased storage capacity.

2. Description of the Prior Art

An automatic accompaniment generation of a rhythm for adaptation to a piece of music by way of a repetition of a rhythm pattern unit responsive to rhythm pattern information selected among several kinds of rhythm pattern information stored in a storage has been proposed, such as in an electronic musical instrument, for the purpose of allowing for simultaneous performance of a music by a performer.

FIG. 1 shows a block diagram of a typical prior art automatic rhythm generator in an electronic musical instrument in which the present invention can be advantageously employed. Referring to FIG. 1, a memory 11 of such as a read only memory for storing rhythm pattern information of different rhythm pattern units is provided, which comprises a plurality of addresses, which are adapted to store various kinds of rhythm pattern units, with a predetermined plurality of addresses, say 48 addresses, being allotted for storing one kind of rhythm pattern unit. The read only memory 11 is operatively coupled to an address counter 12, such that the read only memory 11 is supplied with addressing information for selectively generating a desired rhythm by way of a repetition of a rhythm pattern unit. The address counter 12 is operatively coupled to a rhythm selecting circuit 13, such that the data representing a head address of each kind of rhythm pattern unit as selected by the rhythm selecting circuit 13 is applied to the address counter 12. The address counter 12 is further connected to receive, as a reset signal, through an OR gate 144, a rise differentiated output of a differentiation circuit 143 including a capacitor and a resistor obtainable responsive to the output of a flip-flop 142 of a toggle type or a T type, the storing state of which is reversed upon depression of a start stop command switch 141. The address counter 12 is further supplied with, as a step command signal, the output pulse of a clock generator 151 which is adapted to generate a reference clock signal. The output pulse of the clock generator 151 is also applied to a frequency divider 152, which is adapted to frequency divide the output pulse of the clock generator 151 to the number of addresses, say 48, adapted for storing one kind of rhythm pattern unit, and the output of the frequency divider 152 is also applied, as a head address command signal, i.e. a repetition command signal, to the address counter 12 through the OR gate 144. The clock generator 51 is connected to receive, as a clock generation command signal, the output of the toggle type flip-flop 142. Preferably, in order to adjust a tempo of a selected rhythm pattern, a tempo adjusting variable resistor 153 is operatively coupled to the clock generator 151, so that the oscillation frequency of the clock generator 151 can be varied through adjustment of the variable resistor 153.

Each address of the read only memory 11 comprises a predetermined plurality of bits, say eight bits, with one bit as vacant when seven kinds of musical instruments are intended, with each bit being allotted to a predetermined kind of a musical instrument. The bit outputs of a selected address of the read only memory 11 are applied, in a bit parallel fashion, to corresponding AND gates 161 to 167 at one input of each of the AND gates. The AND gates 161 to 167 are also connected to receive, at the other input of each thereof, the output pulse of the clock generator 151. If and when the logic one has been stored in any one of bits of a selected address of the read only memory 11 as addressed by the address counter 12, then the corresponding one of the AND gates 161 to 167 comes to provide the high level output at the timing of the clock pulse, which is then applied to a corresponding one of tone generators 171 to 177. Each of the tone generators 171 to 177 has been adapted to generate a tone signal of the waveform corresponding to a sound of a musical instrument being determined by each corresponding bit of the selected address of the read only memory 11. The outputs of the respective tone generators 171 to 177 are mixed and the level of the mixed output is adjusted by a volume adjusting variable resistor 181. The mixed output thus obtained is amplified by an amplifier 182 and is applied to a speaker 183. The tone generators 171 to 177, the variable resistor 181, the amplifier 182 and the speaker 183 constitute a tone generating means. As the address counter 12 counts repetitively the predetermined number of output pulses of the clock generator 151, a mixed rhythm of various musical instruments is generated by way of a repetition of selected rhythm pattern units.

FIG. 2A is an illustration showing musical characters of a samba rhythm by way of an example of a rhythm pattern unit, wherein the samba rhythm is shown by the musical characters for performance by four kinds of musical instruments, i.e. maracas, cymbal, high-bongo and low-bongo. As seen from the illustration, the samba rhythm can be represented as a rhythm pattern including a repetition of a rhythm pattern unit as shown by the musical characters in two measures.

FIG. 2B is an illustration of the musical characters for a slow rock rhythm by way of another example of rhythm pattern unit, wherein the musical characters for performance of the slow rock rhythm by three kinds of musical instruments, i.e. high-hat cymbals, snare drum and bass drum are shown. As seen from the illustration, the slow rock rhythm pattern can be represented by a repetition of a rhythm pattern unit as shown by the musical characters in two measures as shown.

In order to store the rhythm pattern information of various kinds of the rhythms in the above described read only memory 11, a scheme was employed conventionally for generating a shortest note element common to the various kinds of the rhythm pattern units, for example one note of a group of three notes of a three-divided eighth note, by allotting the number of six addresses to a quarter note, so that a samba rhythm in two measures was stored in forty-eight addresses for a four-quarter measure, for example. Table 1 shows a truth table of the data for storing the samba rhythm as shown in FIG. 2A in the read only memory 11. More specifically, referring to Table 1, a storing state for representing a note being produced is represented by the logic one and a storing state for representing a note being not produced is represented by the logic zero. For each address, the first bit position is allotted to maracas, the second bit position is allotted to cymbal, the third bit position is high-bongo, the fourth bit position is allotted to low-bongo, the fifth bit position is allotted to high-hat cymbals, the sixth bit position is allotted to snare drum, and the seventh bit position is allotted to bass drum, so that various kinds of musical instruments are determined by the respective bit positions, while the eighth bit position is left as a vacant address. In the first bit position of the read only memory 11, for example, the logic one is written in the addresses serving as a head address, i.e. the address No. 0, and in every third address among the addresses of the unit number, i.e. forty-eight addresses for storing rhythm information concerning samba, whereby rhythm information concerning samba represented by the notes being produced by a maracas is written in the read only memory 11. Similarly, the storing states of the logic one for the rhythm information of the notes being produced by cymbal, high-bongo and low-bongo are written in the corresponding addresses of the second, third and fourth bit positions in the read only memory 11, as shown in Table 1. The rhythm information concerning slow rock by three kinds of musical instruments, i.e. high-hat cymbals, snare drum and bass drum as shown in FIG. 2B is written in the read only memory by loading the logic one in the corresponding addresses in the storing region for slow rock, i.e. the addresses Nos. 48 to 95 at the fifth, sixth and seventh bit positions, as shown in Table 2.

In operation, for the purpose of generating a rhythm of samba based on the rhythm information preloaded in the above described read only memory 11, first the samba rhythm is selected by means of the rhythm selection circuit 13. Accordingly, the rhythm selection circuit 13 generates the address data for addressing the head address, i.e. the address No. 0 in the read only memory 11 where the rhythm information concerning samba is stored, which address data is applied to the address counter 12 for the purpose of initial setting. If and when the performer depresses the start stop command switch 141, the toggle type flip-flop 142 provides the high level signal. The rise of the high level signal thus obtained is differentiated by the differentiation circuit 143, thereby to provide the rise differentiated output, which is applied through the OR gate 144 to the address counter 12 as an initial setting signal, i.e. a head address command signal. The output of the toggle type flip-flop 142 is also applied to the clock signal generator 151 as an oscillation command signal. Accordingly, the clock generator 151 is enabled to generate reference clock signals of a predetermined cycle. The clock signals thus obtained are applied to the address counter 12 as an address step signal and also applied to the frequency divider 152 and further applied to the AND gates 161 to 167 at one input of each of the gates. Each time the address counter 12 receives the clock signal, a step operation is effected on a one by one address basis from the head address as selected by the rhythm selection circuit 13, whereby the rhythm information of the data as stored in the corresponding addresses of the read only memory 11 is read out. Assuming that the address counter 12 addresses the address No. 0 of the read only memory 11, for example, the logic one in the address No. 0 in the first bit position of the read only memory is read out through the AND gate 161 and is applied to the tone generator 171 to generate a sound signal of maracas and the logic one of the same address in the third bit position is read out through the AND gate 163 and is applied to the tone generator 173 to produce a sound signal of high-bongo, with the result that these sound signals are mixed and amplified by the amplifier 182 and a mixed sound is produced from the speaker 183. As the address counter 12 addresses in succession the first and second addresses, no sound is produced. If and when the address counter 12 addresses the address No. 3, a sound signal is generated by the tone generator 171 corresponding to the maracas. Thus, the address counter 12 makes a stepping operation in succession responsive to the reference clock signal obtainable from the clock generator 151, whereby the rhythm information of the data preloaded in the respective addresses is read out to control the tone generators, so that a mixed sound is produced. If and when the address counter 12 reaches the step value of the final address, i.e. the address No. 47 storing the rhythm information concerning samba, then the frequency divider 152 is responsive to the following clock signal to provide the frequency divided output obtainable as a result of frequency division of the reference clock signals by the frequency division rate of 1/48. The frequency divided output is applied through the OR gate 144 to the address counter 12 as a repeat command signal, for commanding return to the head address for storing the rhythm information concerning samba selected by the rhythm selection circuit 13 for the purpose of repetition of the above described operation. The above described operation is thus repeated until the start stop command switch 141 is again depressed, thereby to provide a stop signal to the toggle type flip-flop 142.

If and when the rhythm selection circuit 13 selects the rhythm of slow rock, the rhythm selection circuit 13 provides the address data addressing the head address for storing the rhythm information concerning slow rock i.e. the address No. 48, to the address counter 12. As a result, each time the address counter 12 is supplied with the reference clock signal, the addresses are in succession designated from the address No. 48, and the frequency divider 152 is responsive to the clock pulse signal obtainable following the addressing of the address No. 95 to provide the frequency divided output, thereby to repeat the addressing operation starting from the address No. 48. Although various other kinds of rhythm patterns are stored in the other addresses of the read only memory 11, further description thereof will be omitted.

The above described scheme, however, involves various disadvantages. More specifically, since the above described scheme is adapted such that the rhythm information is stored in the corresponding addresses of the read only memory and is read in synchronism with the reference clock signal being generated, the logic zero need to be written in the addresses where no sound is produced, which increases a required storage capacity of the read only memory, which in turn increases the cost. This problem is aggravated by an increase of the number of kinds of the rhythm patterns, in view of a corresponding increase of the storage capacity and the cost.

SUMMARY OF THE INVENTION

Briefly described, the present invention is characterized in that information concerning the same kinds of rhythm pattern units is stored by allotting the shortest note element to one address, the number of reference clock pulses that can be counted during a period for generating the shortest note element for each kind of rhythm pattern is stored in advance as a skip number for each kind of rhythm pattern, and the addressing operation of the storage is skipped each time a predetermined number of reference clock signals are applied.

Therefore, a principal object of the present invention is to provide a method and apparatus for automatically generating a rhythm in an electronic musical instrument, wherein a storage for storing information concerning the rhythm pattern units may be of a relatively small capacity and accordingly is inexpensive.

Another object of the present invention is to provide a method and apparatus for automatically generating a rhythm in an electronic musical instrument, wherein the addressing operation of a storage for storing information concerning the rhythm pattern units is stepped at every predetermined number of skips suited for a selected kind of rhythm pattern responsive to selective operation of the kinds of rhythm patterns being produced.

These objects and other objects, features, aspects and advantages of the present invention will become more apparent from the following detailed description when taken in conjunction with the accompanying drawings.

DESCRIPTION OF THE PREFERRED EMBODIMENTS

Figure 2A:
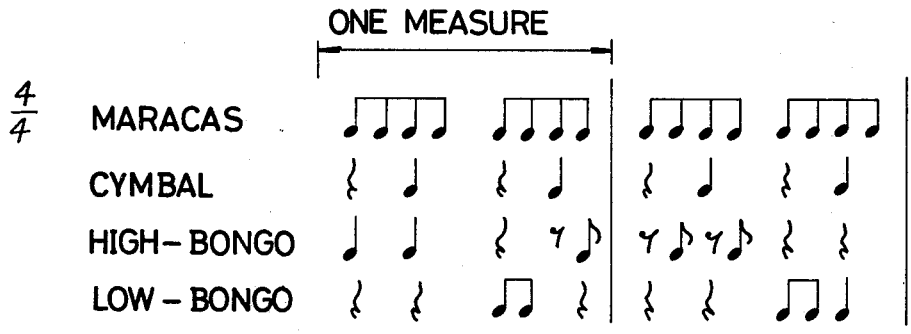
FIG. 2A is an illustration showing the musical characters of a samba rhythm by way of an example of a rhythm pattern unit.
Figure 2B:
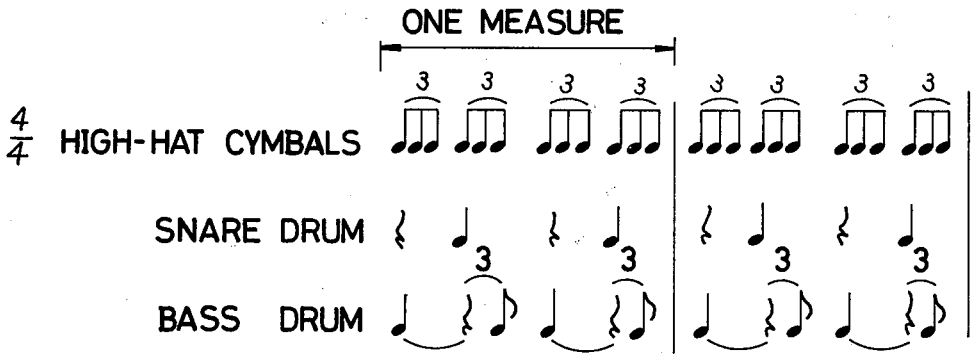
FIG. 2B is an illustration showing the musical characters of a slow rock rhythm by way of another example of rhythm pattern unit.
Figure 3:
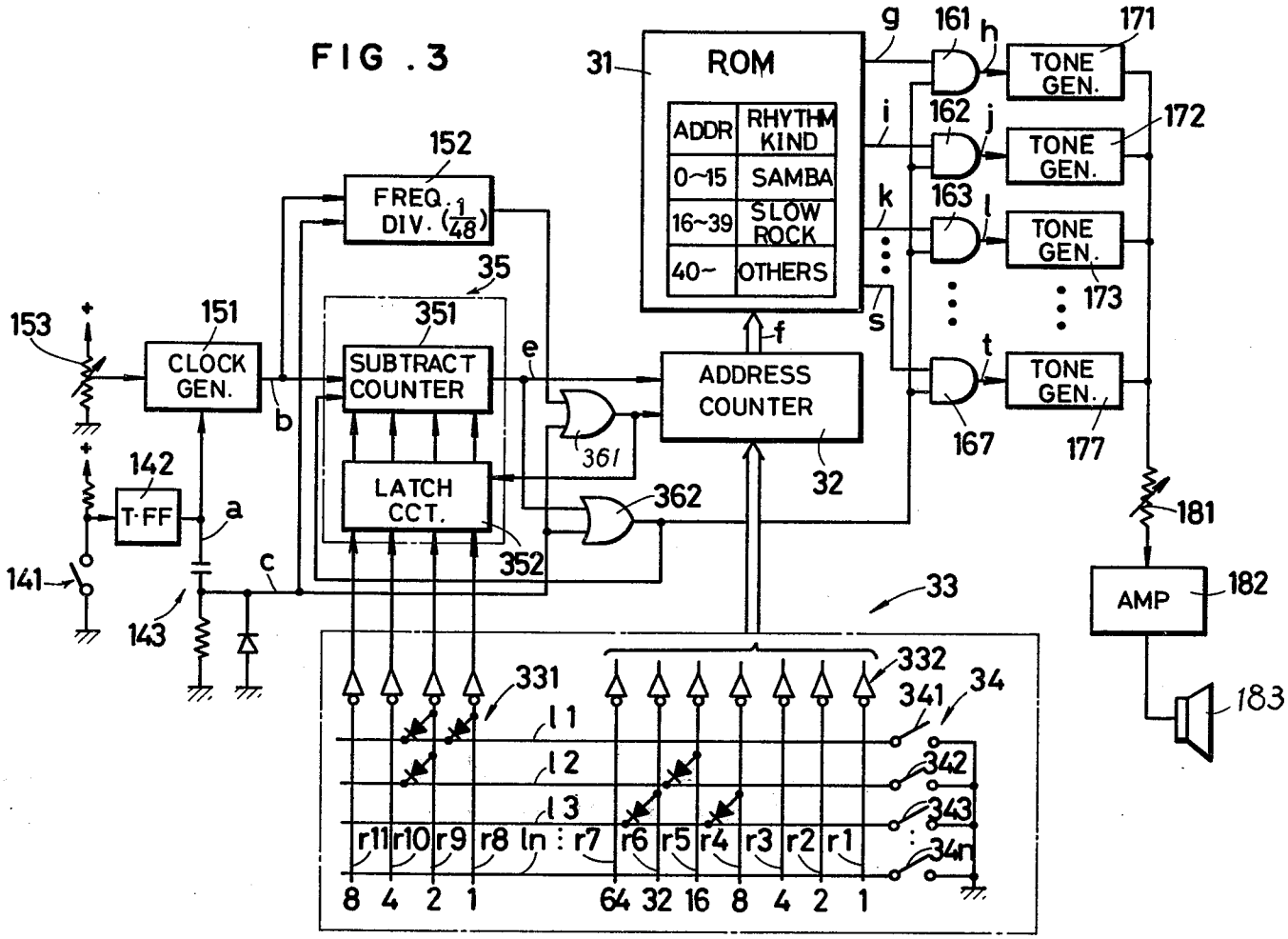
FIG. 3 shows a block diagram of one embodiment of the automatic rhythm generator according to the invention.

FIG. 3 shows a block diagram of one embodiment of the automatic rhythm generator according to the invention for use in an electronic musical instrument. Referring to FIG. 3, a rhythm information storing memory 31 of the embodiment shown may comprise a read only memory, for example, adapted for storing the shortest note among the same kinds of rhythm patterns in one address. For example, assuming a samba rhythm as shown in FIG. 2A, the storing states of the rhythm information in terms of the logics in the read only memory 31 may be shown as in Table 3, wherein one address is used to store the rhythm of an eighth note, and assuming that the head address is the address No. 0, the information is stored using the storing region including sixteen addresses Nos. 0 to 15. In case of slow rock rhythm as shown in FIG. 2B, the storing states of the rhythm information in terms of the logics in the read only memory 31 may be shown as in Table 4, wherein a note of a group of the three shortest notes is stored in one address, so that the information is stored in the storing region including 24 addresses Nos. 16 to 39. In comparison of Table 3 with Table 1, in case where a samba rhythm pattern is stored in the read only memory 31, the number of addresses required for the storing region is reduced to one-third as compared with the prior art scheme. Similarly, comparison of Table 4 with Table 2 shows that when a slow rock rhythm pattern is to be stored using the read only memory 31 the number of addresses required for storing the rhythm information is reduced to a half as compared with the prior art scheme.

Figure 1:
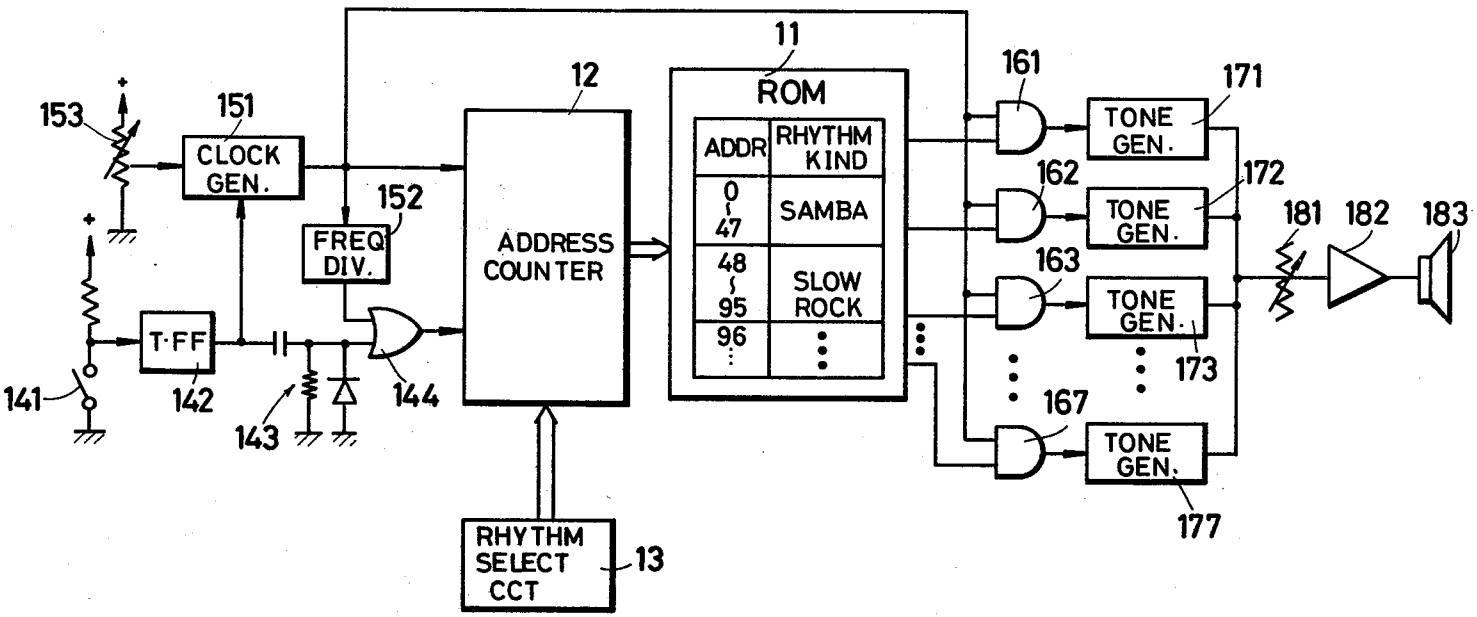
FIG. 1 PRIOR ART
FIG. 1 shows a block diagram of a typical automatic rhythm generator in an electronic musical instrument.

The read only memory 31 is supplied with the addressing information from an address counter 32. The address counter 32 is operatively coupled to a rhythm selection circuit 33 constituting an essential feature of the embodiment, so that information concerning the head address of each kind of rhythm being selected by the rhythm selection circuit 33 is applied to the address counter 32. The address counter 32 is also operatively coupled to a programmable frequency divider 35, so that the output of the programmable frequency divider 35 is applied to the address counter 32 as a step command signal. The rhythm selection circuit 33 comprises a matrix circuit 331 serving as a first presetting portion for presetting the number of skips for each kind of rhythms, a matrix circuit 332 serving as a second presetting portion for presetting the head address of each kind of rhythms in the read only memory 31, and a rhythm kind selection switch 34 for selecting a desired kind of rhythm patterns. For example, let it be assumed that rhythm information concerning a samba rhythm by way of one kind of rhythms is stored in the storing region including the addresses Nos. 0 to 15 in the read only memory 31, the rhythm information concerning a slow rock rhythm by way of another kind of rhythms is stored in the storing region including the addresses Nos. 16 to 39, and rhythm information concerning other kinds of rhythms is stored in the storing regions including the addresses Nos. 40 and more. A samba selection switch 341 of the switch 34 is connected to a row line l1 of the matrix circuits 331 and 332, a slow rock selecting switch 342 of the switch 34 is connected to a row line l2 of the matrix circuits 331 and 332, and other selecting switches 343 to **34*n* of the switch 34 are connected to the corresponding row lines l3 to ln in the matric circuits 331 and 332. Column lines r1, r2, r3, r4, r5, r6 and r7 of the matrix circuit 33 are afforded the weights of 1, 2, 4, 8, 16, 32 and 64, respectively, and connected to the address counter 32. Similarly, column lines r8, r9, r10 and r11 of the matrix circuit 331 are afforded the weights of 1, 2, 4 and 8, respectively, and connected to a latch circuit 352 to be described subsequently. Since the matrix circuit 332 has no diode connected between the row line l1 and the column lines r1 to r7, it follows that the head address of the samba rhythm is preset to correspond to the address No. 0. Similarly, since the matrix circuit 332 has diodes connected between the row line l2 and the column line r5, it follows that the head address of the slow rock rhythm is preset to correspond to the address No. 16. Similarly, since the matrix circuit 332** has diodes connected between the row line l3 and the column lines r4 and r6, it follows that the head address of another kind of rhythm following the above described slow rock rhythm is preset to correspond to the address No. 40. Similarly, the head addresses corresponding to the rhythms being selected by the respective selection switches 334 to 34*n* are preset in the above described manner. On the other hand, the matrix circuit 331 has diodes connected between the row line l1 and the column lines r8 r9, so that the skip number of three for the samba rhythm is preset. The matrix circuit 331 further has diodes connected between the row line l2 and the column line r9, so that the skip number of two for the slow rock rhythm is preset. The output off the information thus preloaded in the matrix circuit 331 is applied to a latch circuit 352 included in the programmable frequency divider 35. Read only memories may be substituted for the above described matrix circuits 331 and 332 for the purpose of the above described preloading of necessary information concerning the head address and the skip number. Since the other portions of the FIG. 3 embodiment are the same as those shown in the FIG. 1 diagram, like portions have been denoted by like reference characters, while a detailed description of the same will be omitted.

Figure 4A:
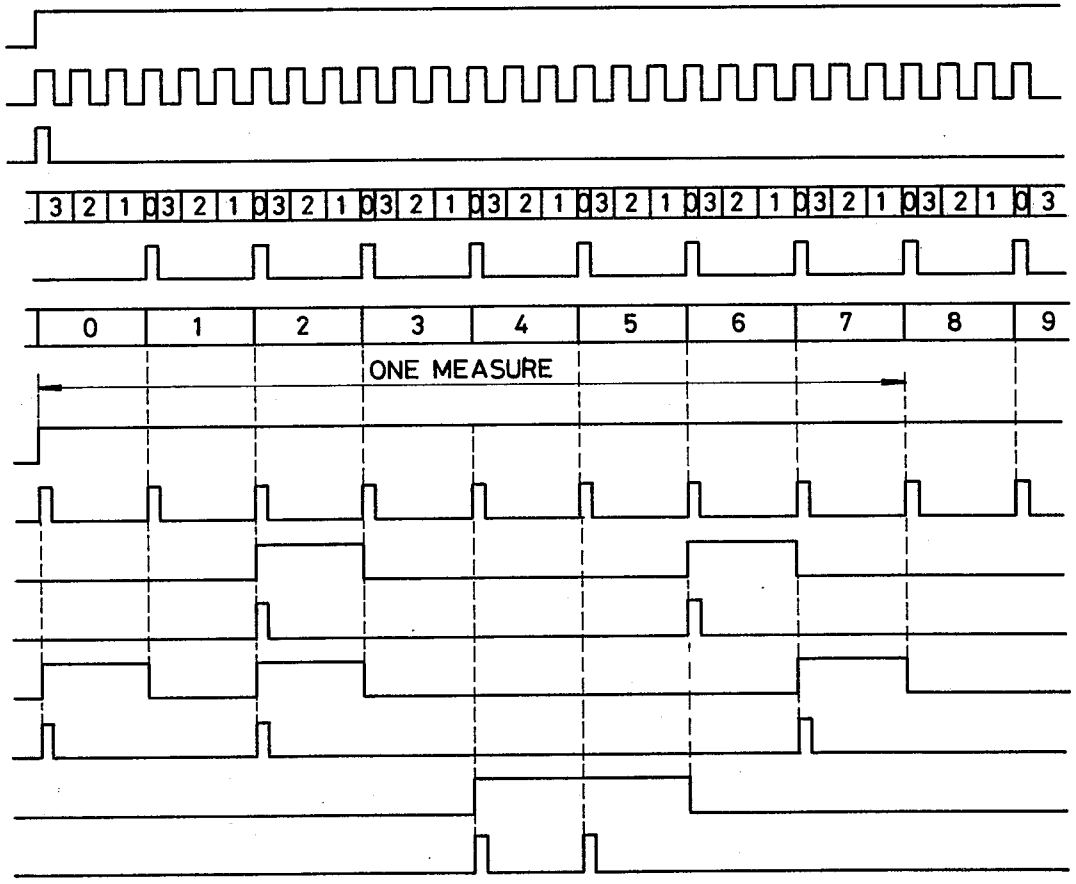
FIG. 4A shows waveforms of electrical signals at various portions in the FIG. 3 diagram obtained in generating a samba rhythm.

FIG. 4A shows waveforms of electrical signals at various portions in the FIG. 3 embodiment in case where a samba rhythm is to be produced, wherein the wave (a) shows the output of the toggle type flip-flop 142, the waveform (b) shows the reference clock signal, the waveform (c) shows the differentiated output pulse, the illustration (d) shows a count by a subtracting counter 351, the waveform (e) shows the output pulse of the subtracting counter 351, the illustration (f) shows the address information obtained by the address counter 32, the waveform (g) shows the state of output of the first bit position of the selected address in the read only memory 31, the waveform (h) shows the output of the AND gate 161, the waveform (i) shows the state of the output from the second bit position of the selected address of the read only memory, the waveform (j) shows the output of the AND gate 162, the waveform (k) shows the state of the output from the third bit position of the selected address in the read only memory, the waveform (l) shows the output of the AND gate 163, the waveform (m) shows the state of the output from the fourth bit position of the selected address in the read only memory, and the waveform (n) shows the output of the AND gate 164, not shown, receiving the output from the fourth bit position of a selected address in the read only memory and the pulse e.

Now referring to FIGS. 3 and 4A, an operation for generating a samba rhythm will be described. A preformer first closes the samba selection switch 341 of the rhythm kind selection switch 34 and depresses the start stop command switch 141. The toggle type flip-flop 142 is responsive to depression of the start stop command switch 141, thereby to continually provide the high level signal a. The rise of the above described high level signal a obtained from the toggle type flip-flop 142 is differentiated by the differentiation circuit 143 comprising a capacitor and a resistor, thereby to provide a rise differentiated output c. The differentiated output pulse c is applied through the OR gate 361 to the latch circuit 352 as a skip number read command signal and is also applied to the frequency divider 152 to reset the same. The differentiated output pulse c is also applied through the OR gate 361 to the address counter 32 as a head address read command signal of the selected kind of rhythm. The differentiated output pulse c is further applied through the OR gate 362 to the AND gates 161 to 167 at one input of each of the gates. Accordingly, the number of skips of the samba rhythm, say the number of three, preset by the matrix circuit 331 is loaded in the subtracting counter 351 and the head address information concerning the samba rhythm as preset in the matrix circuit 332, say the address No. 0 is loaded in the address counter 32. Since the high level output a of the toggle type flip-flop 142 is applied to the clock generator 151 as a clock generation command signal, the clock generator 151 generates in succession the reference clock signal b of a predetermined cycle during the period where the output of the toggle type flip-flop 142 is in the high level, which reference clock signals are applied to the subtracting counter 351 and the of frequency divider 152. Therefore, each time the reference clock signal b is applied to the subtracting counter 351, the number of skips of the samba rhythm as preset in the matrix circuit 331, i.e. the number of three, is decreased one by one until the count value becomes zero, when the subtracting counter 351 provides the output pulse e. The output pulse e is applied to the address counter 31 as an address step command signal, so that a head address number as read from the matrix 332 is stepped by one address. The output pulse e of the subtracting counter 351 is also applied through the OR gate 362 to the AND gates 161 to 167 at one input of each of the gates. Therefore, the addressing information generated by the address counter 32 is applied to the read only memory 31 as read command address data, whereby the rhythm information stored in the address No. 1 is withdrawn in a bit parallel fashion. Since the address No. 1 of the read only memory 31 has the stored rhythm information concerning a maracas sound in terms of the storing states of the logic one, a tone generation command signal h is obtained through the AND gate 161 and is applied to the tone generator 171, whereby a tone signal of the maracas is produced. At the same time, the output pulse e of the subtracting counter 351 is applied through the OR gate 362 to the subtracting counter 351 as a skip number read command signal, and the subtracting counter 351 is again loaded with the skip number of the samba rhythm, i.e. the number of three, stored in the latch circuit 352. Each time three reference clock signals are obtained from the clock generator 151, the subtracting counter 351 provides the output pulse e, which in succession steps the count value in the address counter 32. The addresses of the read only memory 31 are addressed by the address counter 32 as the same make a stepping operation responsive to the output pulse e and the rhythm information of the respective kinds of musical instruments loaded in the respective bit positions of the selected address is read out in a bit parallel fashion and is applied through the AND gates 161 through 167 at the other input of each of the AND gates. Therefore, each time the output pulse is obtained, the AND gates 161 to 167 provide rhythm information of the respective kinds of musical instruments stored in the respective bit positions in the selected address of the read only memory in terms of the storing states of the logic one, which rhythm information is applied to the corresponding tone generators 171 to 177. The tone signals of the respective kinds of musical instruments generated by the tone generators 171 to 177 are mixed and the mixed output is level adjusted by means of the variable resistor 181 and is amplified by the amplifier 182. The output of the amplifier 182 is applied to the speaker 183, so that the mixed signal is transduced to a sound.

Each time the output pulse e is obtained from the subtracting counter 351, the count value in the address counter 32 is stepped one by one until the count value reaches the address No. 15, when the frequency divider 152 has counted forty-eight clock pulses, thereby to provide one output pulse. The output of the frequency divider 152 is applied through the OR gate 361 to the address counter 32 as a head address read command signal. As a result, the address counter 32 is again loaded with the head address, i.e. the address No. 0 concerning the samba rhythm preloaded in the matrix circuit 332, whereby the address No. 0 of the read only memory 31 is addressed. As a result, a rhythm of two measures is generated.

More specifically, assuming that the read only memory 31 has been loaded with the rhythm information concerning a samba rhythm as shown in Table 3, then if and when the address counter 32 comes to address the address No. 0, the information including the logic one in the first and third bit positions is read out from the read only memory 31 to provide the electrical signals (g) and (k) shown in FIG. 4A, which are applied to the AND gates 161 and 163 at the other input of each of the AND gates. As a result, only the AND gates 161 and 163 provide the tone generation command signals h and l to the tone generators 171 and 173. Similarly thereafter, as the address counter 32 makes in succession a step count to provide an address command, the rhythm information in the respective bit positions of the addresses Nos. 0 to 15 in the read only memory 31 is in succession read out in a bit parallel fashion. Such change of condition is shown by the waveforms (g) to (n) in FIG. 4A.

Figure 4B:
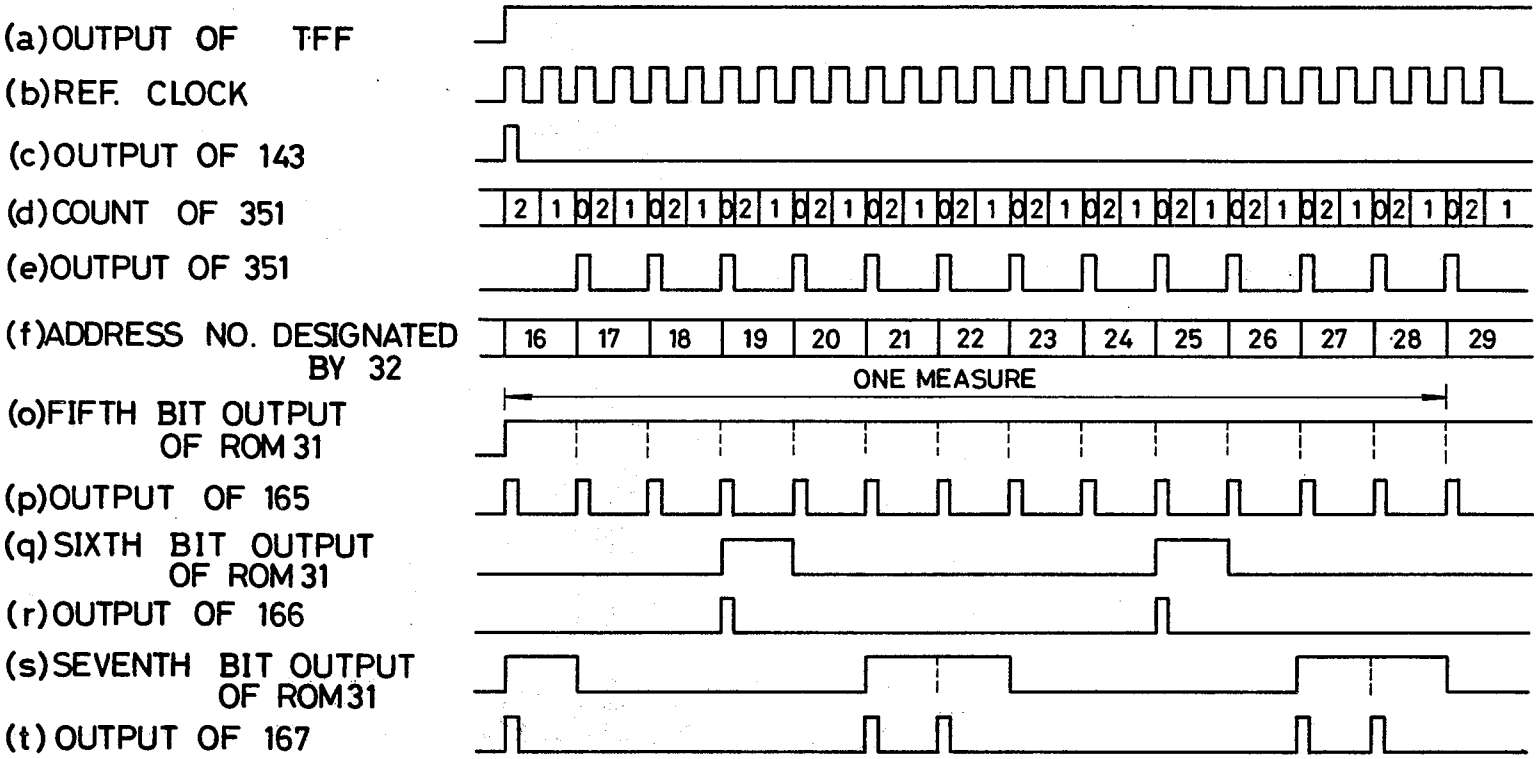
FIG. 4B shows waveforms of electrical signals obtained at various portions in the FIG. 3 diagram when a slow rock rhythm is generated.

FIG. 4B shows waveforms of electrical signals at various portions in the FIG. 3 embodiment when a slow rock rhythm is generated, wherein the waveforms and illustrations (a) to (f) are the same as those shown in FIG. 4A, the waveforms (o) shows the state of the output of the fifth bit position of the respective addresses in the read only memory 31, the waveform (t) shows the output pulse of the AND gate 165, not shown, receiving the output of the fifth bit position of the respective addresses in the read only memory 31 and the pulse e, the waveform (g) shows the state of the output of the sixth bit position in the respective addresses of the read only memory 31, the waveform (r) shows the output of the AND gate 166 not shown, receiving the output of the sixth bit position of the respective addresses of the read only memory 31 and the input pulse e, the waveform (s) shows the state of the output of the seventh bit position of the respective addresses of the read only memory 31, and the waveform (t) shows the output pulse t of the AND gate 167.

Now referring to FIGS. 3 and 4B, an operation for generating a slow rock rhythm will be described. First the performer closes the slow rock selection switch 342 included in the rhythm kind selection switch 34 and depresses the start stop command switch 141. Accordingly, the toggle type flip-flop 142 provides a high level signal a. The rise of the high level signal a is differentiated by the differentiation circuit 143, thereby to provide a rise differentiated output. The differentiated output pulse c is applied through the OR gate 361 to the latch circuit 352 as a skip number read command signal. The differentiated output pulse c is also applied to the frequency divider 152 to reset the same. The differentiated output pulse c is further applied through the OR gate 361 to the address counter 32, thereby to set the head address or the address No. 16 for storing the rhythm information concerning slow rock. The differentiated output pulse is further applied through the OR gate 362 to the AND gates 161 to 167, thereby to enable the same. At that time, the subtracting counter 351 is loaded with the skip number of two of the slow rock rhythm and each time the clock pulse b is applied the subtracting counter 351 makes subtraction one by one to reach the count value zero, when the output pulse e is provided. The output pulse e is applied to the address counter 32, thereby to make a stepping operation of the count value in the address counter 32. Each time the address number counted by the address counter 32 increases, the rhythm information of the respective bit positions in the addresses of the read only memory 31 as addressed by the address counter 32 is read out in a bit parallel fashion and the read output is applied to the AND gates 161 to 167. As a result, the output pulses as shown as (o), (q) and (s) in FIG. 4B are read out in an addressing sequence and the tone generation command signals (p), (r) and (t) are obtained from the AND gates 165 to 167. Accordingly, the corresponding tone generators 175, 176 and 177 are enabled to generate tone signals corresponding to the waveforms of the notes corresponding to the high-hat cymbals, snare drum and bass drum in accordance with the time chart in the address sequence as shown in FIG. 4B. While forty-eight clock signals are applied to the frequency divider 152, the address counter 32 addresses each address of the addresses Nos. 16 to 39 allotted for slow rock, while application of forty-eight clock pulses generates a slow rock rhythm of two measures and the addressing operation from the head address, i.e. the address No. 16 to the final address, i.e. the address No. 39 of the slow rock rhythm is repeated, until the start stop command switch 141 is again depressed to command a stop of the generation of the rhythm, so that the output of the toggle type flip-flop 142 becomes reversed to the low level signal.

Figure 5:
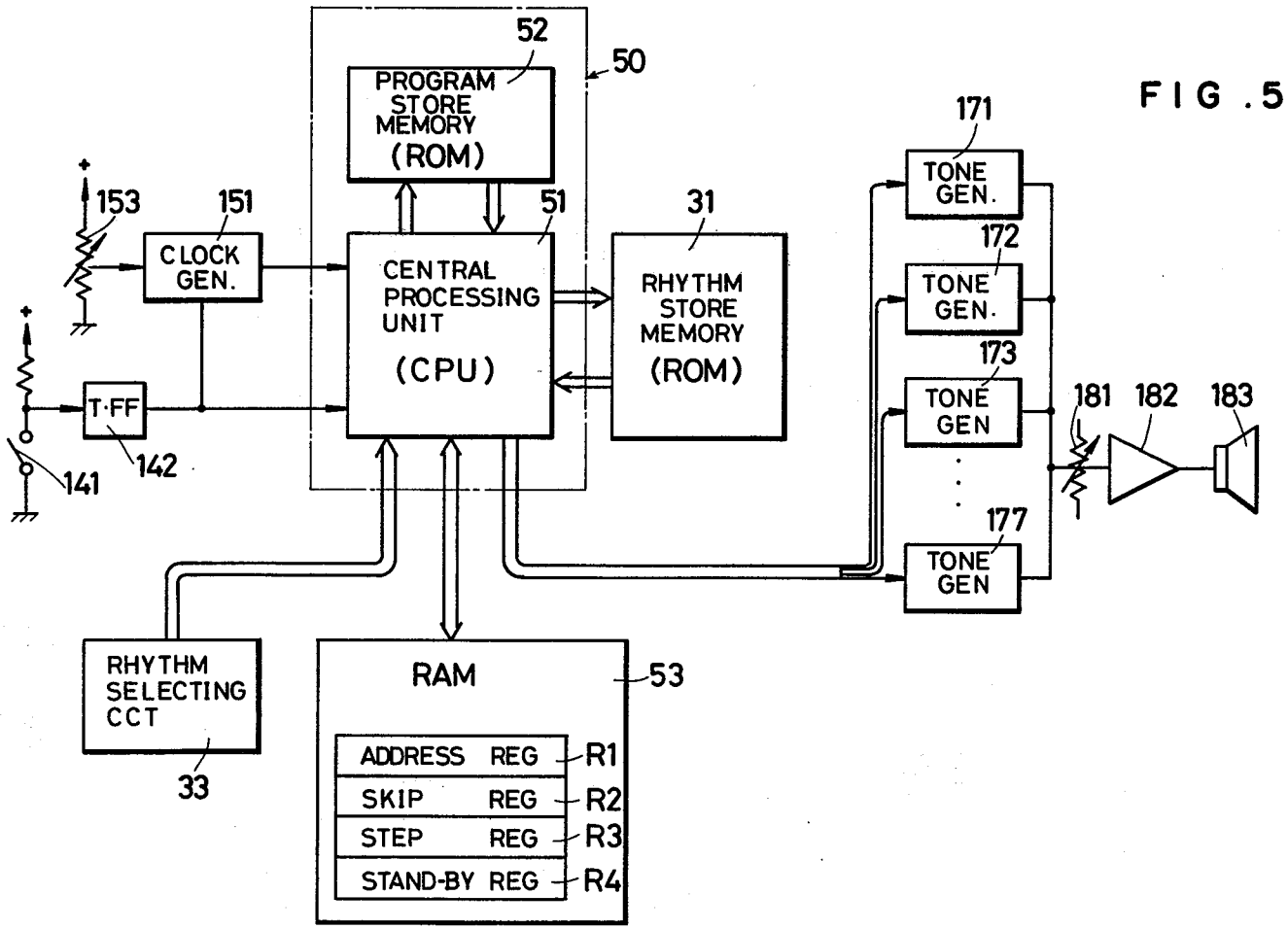
FIG. 5 shows a block diagram of another embodiment of the present invention for use in automatically generating a rhythm in accordance with the present invention.

FIG. 5 shows a block diagram of another embodiment of the present invention for use in automatically generating a rhythm in accordance with the present invention. It is pointed out that the FIG. 5 embodiment aims at automatically generating a rhythm based on rhythm information stored in advance in a memory while the same is read out in accordance with a predetermined microprocessor program satisfying the flow chart of FIG. 6. Referring first to FIG. 5, the embodiment shown comprises a microprocessor 50 including a central processing unit 51 for processing the data based on a predetermined program and a program read only memory 52 for storing the operation program of the central processing unit 51, and a random access memory 53 including a plurality of storing regions capable of writing/reading the data. The above described plurality of storing regions of the random access memory 53 are used as an address register R1, a skip register R2, a step register R3 and a stand-by register R4. The embodiment shown further comprises a read only memory 31 for storing rhythm information, a rhythm selection circuit 33, a start stop command switch 141, a toggle type flip-flop 142, a variable resistor 153, a clock generator 151, tone generators 171 to 177, a volume control variable resistor 181, an amplifier 182 and a speaker 183, which may be the same as those shown in the FIG. 3 embodiment.

Figure 6:
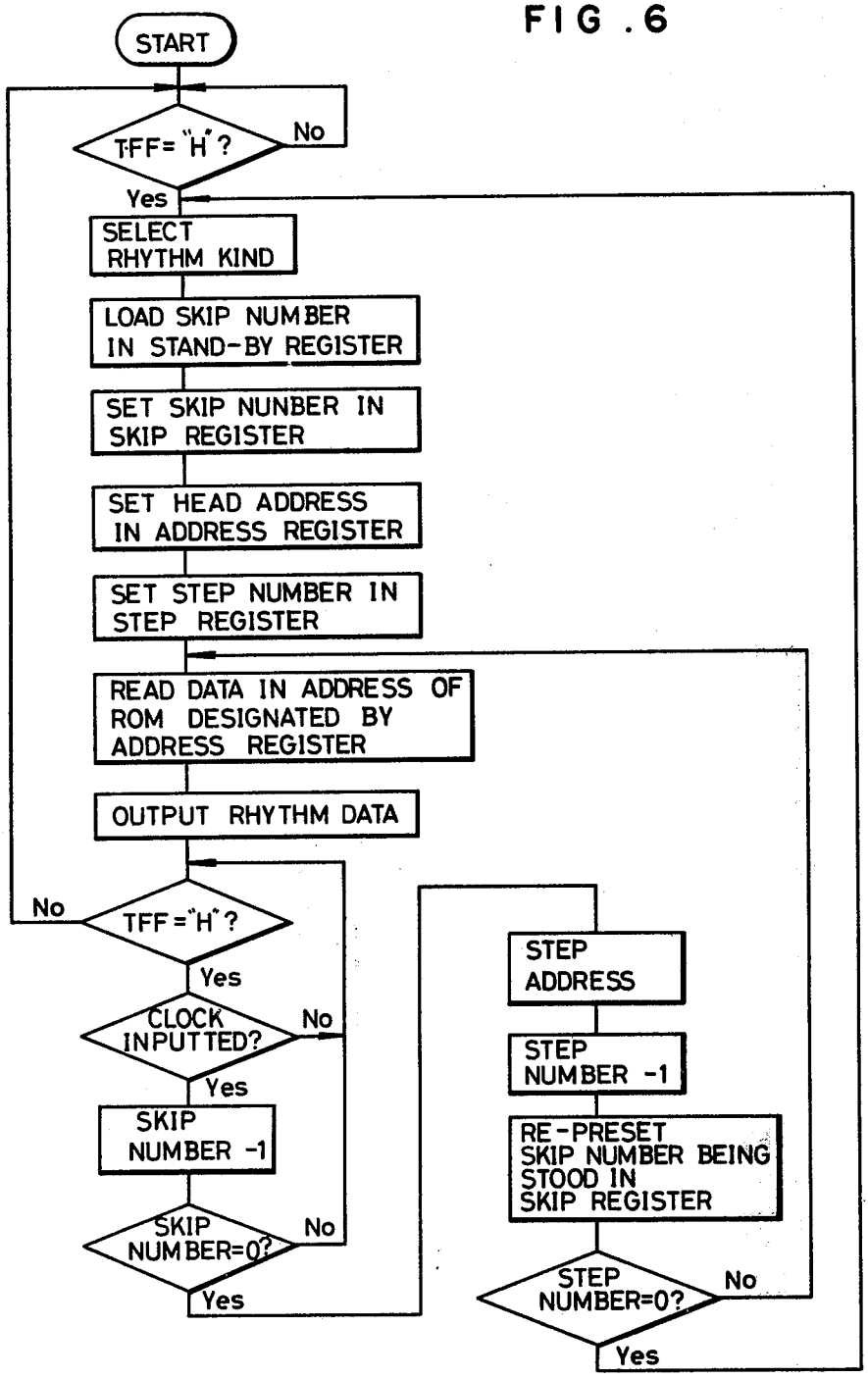
FIG. 6 shows a flow chart for depicting a method for automatically generating a rhythm in accordance with the present invention.

FIG. 6 shows a flow chart for depicting a method for automatically generating a rhythm in accordance with the present invention. With simultaneous reference to FIGS. 5 and 6, the present method will be described. In an initial state, the central processing unit 51 determines whether the output of the toggle type flip-flop 142 is the high level or not, thereby to determine whether the start stop command switch 141 is depressed to command a start. If and when a start has not been commanded, the state is stood by. If and when a start has been commanded, the next step follows. If and when the start stop command switch 141 is depressed, the toggle type flip-flop 142 provides a high level signal, which is applied to the central processing unit 51 and also to the clock generator 151 as a clock generation command signal. Then, the performer operates the rhythm kind selection switch 34 of the rhythm selection circuit 33 to select a desired kind of rhythm, say a samba rhythm. Accordingly, the central processing unit 51 serves to load the skip number of three for the samba rhythm preset in the matrix circuit 331 included in the rhythm selection circuit 33 into the stand-by register R4 of the random access memory 53 for the stand-by purpose and also to the skip register R2 of the random access memory 53, whereupon the head address, i.e. the address No. 0 for the samba rhythm preset in the matrix circuit 332 included in the rhythm selection ciruit 33 is read out and is loaded in the address register R1 of the random access memory 53 and the step number is further loaded in the step register R3 of the random access memory 53. The step number corresponds to the address number, i.e. the No. 16, stored in the read only memory 31 for the samba rhythm, and is obtained by dividing the number of 48 by the step number of 3, i.e. $48 \div 3 = 16$.

The central processing unit 51 then reads out the rhythm information of the address, i.e. the head address, of the read only memory 31 as addressed by the address register R1 in a bit parallel fashion and the rhythm information thus read out is applied to the corresponding tone generators 171 to 177. As a result, the tone generator corresponding to the bit position storing the logic one in the address No. 0 of the read only memory 31 generates a tone signal of a predetermined kind of musical instrument, which is adjusted by the volume adjusting variable resistor 181 and amplified by the amplifier 182, the output of which is applied to the speaker 183 to produce a corresponding sound.

Thereafter the central processing unit 51 determines whether the output of the toggle type flip-flop 142 is the high level signal and, if the output of the toggle type flip-flop 142 is the high level signal, the state is stood by until one reference clock input is obtained by the clock generator 151, and when the reference clock is obtained, the skip number in the skip register R2 is reduced by the value of unity and the new value is loaded in the skip register R2 for the purpose of renewal. The central processing unit 51 further determines whether the skip number is zero, while the above described operation is repeated until the skip number becomes zero. As a result, the above described operation is repeated, until the reference clock signals of the number corresponding to the skip number preset in the skip register R2 are obtained by the clock generator 151. If and when the content in the skip register R2 becomes zero, the numerical value of unity is added to the address number loaded in the address register R1 so that a renewed address number is loaded, whereupon the address being read of the read only memory 31 is stepped. Thereafter, the central processing unit 51 subtracts the numerical value of unity from the step number, say the number of sixteen in case of a samba rhythm, stored in the step register R3 and the subtracted value is loaded in the step register R3 for the purpose of renewal. The central processing unit 51 reloads the skip number stood by in the stand by register R4 in the skip register R2, whereupon the central processing unit 51 determines whether the step number loaded in the step register R3 is zero or not. If the step number is not zero, then the data in the address, i.e. the address No. 1, of the read only memory addressed by the address register R1 is again read out to provide read rhythm information. Similarly thereafter, the above described operation is repeated until the step number becomes zero. While the step number becomes zero, a samba rhythm of two measures as shown in FIG. 2A loaded in the read only memory 31 is in succession read out and a corresponding sound is generated.

Meanwhile, in determining whether the step number is zero, when determination is made of whether the step number stored in the step register R3 has become zero, then the head address of the samba rhythm as preset in the matrix circuit 332 is loaded again in the address register R1 while the step number of 16 is set in the step register R3, whereupon the same operation is repeated thereafter.

If and when generation of a selected rhythm is to be stopped, the start stop command switch 141 is again depressed. Then the output of the toggle type flip-flop 142 is reversed to the low level signal. Then, the central processing unit 51 reads out the rhythm information of the address in the read only memory addressed immediately before, whereupon the initial state is regained.

When the rhythm selection circuit 33 is operated to select a slow rock rhythm as shown in FIG. 2B, then the skip number 2 is loaded in the skip register R2 and the head address, i.e. the address No. 16, for storing rhythm information of the slow rock is loaded in the address register R1 and the step number 24 is loaded in the step register R3, whereupon the above described operation is repeated in the same manner.

Although the present invention has been described and illustrated in detail, it is to be clearly understood that the same is by way of illustration and example only and is not to be taken by way of limitation, the spirit and scope of the present invention being limited only by the terms of the appended claims.

Table 1

| | Samba | | | | | | | | | | | | | | | | | | | | | | | |
|---|---|---|---|---|---|---|---|---|---|---|---|---|---|---|---|---|---|---|---|---|---|---|---|---|
| Address / Bit | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
| 1 Maracas | 1 | 0 | 0 | 1 | 0 | 0 | 1 | 0 | 0 | 1 | 0 | 0 | 1 | 0 | 0 | 1 | 0 | 0 | 1 | 0 | 0 | 1 | 0 | 0 |
| 2 Cymbals | 0 | 0 | 0 | 0 | 0 | 0 | 1 | 0 | 0 | 0 | 0 | 0 | 0 | 0 | 0 | 0 | 0 | 0 | 1 | 0 | 0 | 1 | 0 | 0 |
| 3 High-Bongos | 1 | 0 | 0 | 0 | 0 | 0 | 1 | 0 | 0 | 0 | 0 | 0 | 0 | 0 | 0 | 0 | 0 | 0 | 0 | 0 | 0 | 1 | 0 | 0 |
| 4 Low-Bongos | 0 | 0 | 0 | 0 | 0 | 0 | 0 | 0 | 0 | 0 | 0 | 0 | 1 | 0 | 0 | 1 | 0 | 0 | 0 | 0 | 0 | 0 | 0 | 0 |
| 5 High-Hat Cymbals | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 6 Snare Drum | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

Table 1-continued

Samba

| | | | | | | | | | | | | | | | | | | | | | | | | |
|---|---|---|---|---|---|---|---|---|---|---|---|---|---|---|---|---|---|---|---|---|---|---|---|---|
| 7 Bass Drum | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

| Bit \ Address | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 |
|---|---|---|---|---|---|---|---|---|---|---|---|---|---|---|---|---|---|---|---|---|---|---|---|---|
| 1 Maracas | 1 | 0 | 0 | 1 | 0 | 0 | 1 | 0 | 0 | 1 | 0 | 0 | 1 | 0 | 0 | 1 | 0 | 0 | 1 | 0 | 0 | 1 | 0 | 0 |
| 2 Cymbals | 0 | 0 | 0 | 0 | 0 | 0 | 1 | 0 | 0 | 0 | 0 | 0 | 0 | 0 | 0 | 0 | 0 | 0 | 1 | 0 | 0 | 0 | 0 | 0 |
| 3 High-Bongos | 0 | 0 | 0 | 1 | 0 | 0 | 0 | 0 | 0 | 1 | 0 | 0 | 0 | 0 | 0 | 0 | 0 | 0 | 0 | 0 | 0 | 0 | 0 | 0 |
| 4 Low-Bongos | 0 | 0 | 0 | 0 | 0 | 0 | 0 | 0 | 0 | 0 | 0 | 0 | 1 | 0 | 0 | 1 | 0 | 0 | 1 | 0 | 0 | 0 | 0 | 0 |
| 5 High-hat Cymbals | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 6 Snare Drum | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 Bass Drum | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

Table 2

Slow Rock

| Bit \ Address | 48 | 49 | 50 | 51 | 52 | 53 | 54 | 55 | 56 | 57 | 58 | 59 | 60 | 61 | 62 | 63 | 64 | 65 | 66 | 67 | 68 | 69 | 70 | 71 |
|---|---|---|---|---|---|---|---|---|---|---|---|---|---|---|---|---|---|---|---|---|---|---|---|---|
| 1 Maracas | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 Cymbals | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3 High-Bongos | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 Low-Bongos | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 High-Hat Cymbals | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 |
| 6 Snare Drum | 0 | 0 | 0 | 0 | 0 | 0 | 1 | 0 | 0 | 0 | 0 | 0 | 0 | 0 | 0 | 0 | 0 | 0 | 1 | 0 | 0 | 0 | 0 | 0 |
| 7 Bass Drum | 1 | 0 | 0 | 0 | 0 | 0 | 0 | 0 | 0 | 0 | 1 | 0 | 1 | 0 | 0 | 0 | 0 | 0 | 0 | 0 | 0 | 0 | 1 | 0 |

| Bit \ Address | 72 | 73 | 74 | 75 | 76 | 77 | 78 | 79 | 80 | 81 | 82 | 83 | 84 | 85 | 86 | 87 | 88 | 89 | 90 | 91 | 92 | 93 | 94 | 95 |
|---|---|---|---|---|---|---|---|---|---|---|---|---|---|---|---|---|---|---|---|---|---|---|---|---|
| 1 Maracas | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 Cymbals | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3 High-Bongos | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 Low-Bongos | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 High-Hat Cymbals | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 |
| 6 Snare Drum | 0 | 0 | 0 | 0 | 0 | 0 | 1 | 0 | 0 | 0 | 0 | 0 | 0 | 0 | 0 | 0 | 0 | 0 | 1 | 0 | 0 | 0 | 0 | 0 |
| 7 Bass Drum | 1 | 0 | 0 | 0 | 0 | 0 | 0 | 0 | 0 | 0 | 1 | 0 | 1 | 0 | 0 | 0 | 0 | 0 | 0 | 0 | 0 | 0 | 1 | 0 |

Table 3

Samba

| Bit \ Address | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 1 Maracas | 1 | 1 | 1 | 1 | 1 | 1 | 1 | 1 | 1 | 1 | 1 | 1 | 1 | 1 | 1 | 1 |
| 2 Cymbals | 0 | 0 | 1 | 0 | 0 | 0 | 1 | 0 | 0 | 0 | 1 | 0 | 0 | 0 | 1 | 0 |
| 3 High-Bongos | 1 | 0 | 1 | 0 | 0 | 0 | 0 | 1 | 0 | 1 | 0 | 1 | 0 | 0 | 0 | 0 |
| 4 Low-Bongos | 0 | 0 | 0 | 0 | 1 | 1 | 0 | 0 | 0 | 0 | 0 | 0 | 1 | 1 | 1 | 0 |
| 5 High-Hat Cymbals | 0 | 0 | 0 | 0 | 0 | 0 | 0 | 0 | 0 | 0 | 0 | 0 | 0 | 0 | 0 | 0 |
| 6 Snare Drum | 0 | 0 | 0 | 0 | 0 | 0 | 0 | 0 | 0 | 0 | 0 | 0 | 0 | 0 | 0 | 0 |
| 7 Bass Drum | 0 | 0 | 0 | 0 | 0 | 0 | 0 | 0 | 0 | 0 | 0 | 0 | 0 | 0 | 0 | 0 |

Table 4

Slow Rock

| Bit \ Address | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 |
|---|---|---|---|---|---|---|---|---|---|---|---|---|---|---|---|---|---|---|---|---|---|---|---|---|
| 1 Maracas | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 Cymbals | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3 High-Bongos | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 Low Bongos | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 High-Hat Cymbals | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |
| 6 Snare Drum | 0 | 0 | 0 | 1 | 0 | 0 | 0 | 0 | 0 | 1 | 0 | 0 | 0 | 0 | 0 | 1 | 0 | 0 | 0 | 0 | 0 | 1 | 0 | 0 |
| 7 Bass Drum | 1 | 0 | 0 | 0 | 0 | 1 | 1 | 0 | 0 | 0 | 0 | 1 | 1 | 0 | 0 | 0 | 0 | 1 | 1 | 0 | 0 | 0 | 0 | 1 |

What is claimed is:

1. An apparatus for automatically generating a rhythm signal in an electronic musical instrument based on rhythm information, comprising: storage means including a storing region having a plurality of addresses for storing, in an address sequence, rhythm information concerning a given kind of rhythm pattern comprising a combination of first and second information units representing notes in binary form, reference clock signal generating means for generating reference clock signals, read commanding means for commanding reading of said rhythm information from said storage means, addressing means operatively coupled to said storage means and responsive to said read commanding means and said clock signal generating means for addressing said addresses of said storage means for reading said rhythm information stored in said storage means, presetting means for presetting the number of said clock signals associated with said kind of rhythm pattern and required for skipping the addresses of said storage means for reading said rhythm information, address controlling means responsive to said read commanding means and said clock signals for controlling said addressing means for skipping in succession said addresses being addressed each time said preset number of said clock signals are supplied, and means responsive to said rhythm information read from said storage means for generating a rhythm signal representing said rhythm pattern stored in said storage means.

2. An apparatus for automatically generating a rhythm signal in an electronic musical instrument in accordance with claim 1, wherein said rhythm information concerns a plurality of kinds of rhythm patterns, said storage means comprises a plurality of storing regions allotted for said plurality of kinds of rhythm patterns, said presetting means comprises rhythm kind selecting means for selecting one of said plurality of kinds of rhythm patterns, first presetting means for presetting the number of clock signals required for skipping the addresses of said storage means for each of said kinds of rhythm patterns, and second presetting means for presetting a head address of each storing region of the corresponding one of said plurality of kinds of rhythm patterns stored in said storing means, and said address controlling means comprises head address controlling means responsive to said read commanding means, said rhythm kind selecting means and said second presetting means for controlling said addressing means for skipping the addresses of said storage means to said head address of said addresses of said storing region of said selected rhythm pattern, and skip controlling means responsive to said first presetting means and said clock signals for skipping said addresses each time said preset number of said clock signals of said selected kind of rhythm pattern for reading rhythm information of said selected kind of rhythm pattern.

3. An apparatus for automatically generating a rhythm signal in an electronic musical instrument in accordance with claim 1, wherein each address comprises a plurality of bit positions allotted to a plurality of kinds of musical instruments, and said rhythm signal generating means comprises a plurality of rhythm signal generating means coupled to receive the read outputs of said plurality of bit positions in each address.

4. An apparatus for automatically generating a rhythm signal in an electronic musical instrument in accordance with claim 2, wherein said address controlling means comprises means responsive to clock signals for resetting said addressing means to an initial state each time a number of clock signals required for reading said rhythm information of a predetermined number of measures stored in said storage means are supplied.

5. An apparatus for automatically generating a rhythm signal in an electronic musical instrument in accordance with claim 1, which further comprises means operatively coupled to said reference clock signal generating means for adjustably varying the frequency of said reference clock signals.

6. An apparatus for automatically generating a rhythm signal in an electronic musical instrument based on rhythm information, comprising: storage means including a storing region having a plurality of addresses for storing, in an address sequence, rhythm information concerning a given kind of rhythm pattern comprising a combination of first and second information units, representing notes in binary form, reference clock signal generating means for generating reference clock signals of a given frequency, frequency modifying means responsive to said reference clock signals for modifying the frequency of said reference clock signals at a given frequency modification rate, first presetting means for presetting information concerning a frequency modification rate associated with said kind of rhythm pattern, frequency modification rate controlling means responsive to said first presetting means and operatively coupled to said frequency modifying means for modifying the frequency modification rate by said frequency modifying means as a function of said information concerning a frequency division rate associated with said kind of rhythm pattern, addressing means responsive to said frequency modifying means and operatively coupled to said storage means for addressing, in an address sequence, said addresses of said storage means for reading said rhythm information stored in said storage means, and means responsive to said rhythm information read from said storage means for generating a rhythm signal representing said rhythm pattern stored in said storage means.

7. An apparatus for automatically generating a rhythm signal in an electronic musical instrument in accordance with claim 6, wherein said rhythm information concerns a plurality of kinds of rhythm patterns, said storage means comprises a plurality of storing regions allotted to said plurality of kinds of rhythm patterns, and said first presetting means is adapted for presetting information concerning a plurality of frequency modification rates for said kinds of rhythm patterns, and which further comprises rhythm kind selecting means operatively coupled to said first presetting means for selecting one of said plurality of frequency modification rates for selecting one of said plurality of kinds of rhythm patterns.

8. An apparatus for automatically generating a rhythm signal in an electronic musical instrument in accordance with claim 7, which further comprises second presetting means for presetting a head address of each storing region of the corresponding one of said plurality of kinds of rhythm patterns stored in said storage means, and head address controlling means responsive to said rhythm kind selecting means and said second presetting means for controlling said addressing means for skipping the addresses of said storage means to said head address of said storing region of said selected rhythm pattern.

9. An apparatus for automatically generating a rhythm signal in an electronic musical instrument in accordance with claim 6, wherein each address of said storage means comprises a plurality of bit positions allotted to a plurality of kinds of musical instruments, and said rhythm signal generating means comprises a plurality of rhythm signal generating means coupled to receive the read outputs of said plurality of bit positions in each address.

10. An apparatus for automatically generating a rhythm signal in an electronic musical instrument in accordance with claim 6, which further comprises initial resetting means responsive to said reference clock signals for resetting said addressing means to an initial state each time a predetermined number of reference clock signals required for reading said rhythm information of a predetermined number of measures stored in said storage means are supplied.

11. An apparatus for automatically generating a rhythm signal in an electronic musical instrument in accordance with claim 6, which further comprises tempo adjusting means operatively coupled to said reference clock signal generating means for adjustably varying the frequency of said reference clock signals.

12. A method for automatically generating a rhythm signal in an electronic musical instrument based on rhythm information, comprising the steps of storing in storage means including a plurality of storing regions having a plurality of addresses, in an address sequence, rhythm information concerning a plurality of kinds of rhythm patterns comprising a combination of first and second information units representing notes in binary form, said plurality of storing regions being allotted to said plurality of kinds of rhythm patterns; generating reference clock signals of a given frequency, presetting information concerning a frequency division rate associated with said kind of rhythm pattern by selecting one of said plurality of kinds of rhythm patterns and then presetting information concerning a plurality of modification rates for each of said kinds of rhythm patterns, modifying the frequency of said reference clock signal as a function of said preset information concerning a frequency modification rate associated with said kind of rhythm pattern, addressing, as a function of said frequency modified output, in an address sequence, said addresses of said storage means for reading said rhythm information stored in said storage means, generating, as a function of said rhythm information read from said storage means, a rhythm signal representing said rhythm pattern stored in said storage means, presetting a head address for each storing region of the corresponding one of said plurality of kinds of rhythm patterns stored in said storage means, and controlling said addressing step, as a function of the selection of the kind of rhythm pattern, for skipping the addresses of said storage means to reach said head address of said addresses of said storing region of said selected rhythm pattern.

13. A method for automatically generating a rhythm signal in an electronic musical instrument in accordance with claim 12, wherein each address of said storage means comprises a plurality of bit positions allotted to a plurality of kinds of musical instruments, and said rhythm signal generating step comprises the step of generating a plurality of rhythm signals each representing said rhythm pattern stored in each of said plurality of bit positions in each address.

14. A method for automatically generating a rhythm signal in an electronic musical instrument in accordance with claim 12, which further comprises the step of resetting, as a function of said reference clock signals, said addressing step to an initial state each time a number of reference clock signals required for reading said rhythm information of a predetermined number of measures stored in said storage means are supplied.

* * * * *